United States Patent [19]

Weiner

[11] Patent Number: 4,920,590

[45] Date of Patent: May 1, 1990

[54] INVALID LIFTING AND CARRYING APPARATUS

[76] Inventor: Rudolf Weiner, Danziger Str. 62, 6360 Friedberg, Fed. Rep. of Germany

[21] Appl. No.: 234,161

[22] Filed: Aug. 19, 1988

[30] Foreign Application Priority Data

Sep. 8, 1987 [DE] Fed. Rep. of Germany ..... 3729987

[51] Int. Cl.[5] ..... A61G 7/10

[52] U.S. Cl. ..... 5/86; 5/83

[58] Field of Search ..... 5/86, 81 R, 81 B, 83, 5/87; 414/921, 912, 603, 641, 642

[56] References Cited

U.S. PATENT DOCUMENTS

| | | | |
|---|---|---|---|
| 3,659,594 | 5/1972 | Schwab | 5/87 X |
| 3,666,131 | 5/1972 | Thompson | 5/86 X |
| 3,732,584 | 5/1973 | James | 5/86 |
| 3,790,974 | 2/1974 | Johansson | 5/86 |
| 3,829,916 | 8/1974 | James | 5/86 |
| 3,914,808 | 10/1975 | Woods | 5/86 |
| 3,940,808 | 3/1976 | Petrini | 5/81 R X |
| 3,981,484 | 9/1976 | James | 5/81 R |
| 4,569,094 | 2/1986 | Hart et al. | 5/81 R |
| 4,633,538 | 1/1987 | James | 5/86 |
| 4,703,523 | 11/1987 | James | 5/83 |
| 4,712,257 | 12/1987 | James | 5/83 |
| 4,761,842 | 8/1988 | Weiner | 5/86 |

*Primary Examiner*—Gary L. Smith
*Assistant Examiner*—Michael J. Milano
*Attorney, Agent, or Firm*—Wegner & Bretschneider

[57] ABSTRACT

An invalid lifting and carrying apparatus has a standard (1) on the outside of which a slide (9) is vertically movable. The slide has a cantilever (10) which is fixed tiltable around swivelling axis journals (13). These swivelling axis journals (13) each grip into an elongagted slot (14) of the cantilever (10). Stops (15, 21) allow the cantilever (10) to be held in two different positions, one of which is intended for fastening a seat (17), the other for fastening a hanger (22) of a belt device.

5 Claims, 2 Drawing Sheets

INVALID LIFTING AND CARRYING APPARATUS

BACKGROUND OF THE INVENTION

The invention relates to an invalid lifting and carrying apparatus with a cantilever, consisting of two cantilever components, which is capable of being moved vertically along a standard and which from a position with its frontal area pointing downwards, suitable for holding a seat, may be tilted around a swivelling axis into a position reaching further upwards, suitable for carrying a belt device. Such invalid lifting and carrying apparatus is used currently in hospitals and is familiar.

The familiar invalid lifting and carrying apparatus has cantilever components both of which are connected to each other by a joint. The cantilever component on the standard side always remains in a horizontal direction while the frontal cantilever component may be tilted from an approximately horizontal position into an inclined downwards pointing position, in which it is possible to attach a seat. In the horizontal position a belt device may be hung instead of a seat.

The joint connecting the two cantilever components must be reliably locked in both the front cantilever component's positions, for which reason a catch mechanism is provided. Should the catch mechanism, in particular in the front cantilever component's horizontal position, not be properly locked owing, for example, to functioning difficulties arising because of soiling, it may come about that, during loading of the cantilever, the front cantilever component suddenly tilts downwards which may lead to injury of the patient or the person helping him. A further disadvantage of the familiar invalid lifting and carrying apparatus lies in the fact that, in the cantilever's horizontal position, its furthermost end is not of a sufficient height from the ground for lifting a patient high enough when a customary belt device is used. In this connection, it may be considered that the height of the standard and therefore the maximal possible lifting capacity of the cantilever is relatively slight because otherwise the apparatus could no longer be moved through doors. Tilting the front cantilever component beyond the horizontal position upwards is not possible because the patient would then hang too near to the standard side cantilever component and could injure himself on the latter.

The older German patent application, P 36 18 526.4, describes an invalid lifting and carrying apparatus where pockets are provided leading, from above, into a slide on the outer side of the standard. In these pockets a cantilever may easily be replaced. Thereby, various cantilevers or mountings may be provided for seats and belt devices, so that an optimal adaption onto the lifting area of the invalid lifting and carrying apparatus is possible. A disadvantage related to this, however, is that the appropriate cantilevers must be kept ready, the handling of which is relatively awkward, since they are relatively heavy.

SUMMARY OF THE INVENTION

The object of the invention is to develop an invalid lifting and carrying apparatus of the type named at the beginning, where, in a simple way, a sufficient hoisting height may be obtained when a belt device is used with the patient at a large enough distance away from the standard.

This object is achieved, in accordance with the invention, by the cantilever components meeting unadjustably at an obtuse angle and by providing the cantilever's swivelling axis at one lateral surface of a slide movable on the outer side of the standard and carried by the cantilever.

By means of this embodiment, the cantilever may be tilted in such a way that its standard side cantilever component points upwards in line with the standard. Thereby, danger of injury to the patient on ths cantilever component does not exist. The other cantilever component may be made of such a length that, in an inclined position pointing upwards, its front end obtains a sufficient distance away from the standard.

A particularly advantageous embodiment of the invention lies in the fact that the standard side cantilever component grips along the swivelling axis with an elongated slot and is movable, by means of fixed stops on the slide, by shifting the cantilever on the swivelling axis into a position fixed by means of the stops, with its standard side cantilever component lined upwards and into another position with the standard side cantilever component aligned horizontally. This embodiment makes the use of catch mechanisms for fixing the cantilever unnecessary. The cantilever is simply moved each time, by means of its elongated slot, till an end position is reached where it is located in front of a fixed stop. The cantilever is extremely reliably fixed in this way. Furthermore, the structural cost for fixing the cantilever in both of its positions is very low.

The elongated slot in the standard side cantilever component serves simultaneously in bringing the cantilever, in each of its positions, into an optimal position. In the standard side cantilever component's horizontal position, the cantilever aligned downwards has sufficient distance from the standard to enable extension over a bath, for example. In the standard side cantilever component's vertical position, the cantilever's free is low enough to enable a belt device, with the customary hoisting apparatus, to be lowered right down to the ground.

A greater rigidity of the construction is easily achieved, if the standard side cantilever component takes the form of a fork which grips on both sides over the slide and if swivelling axis journals are provided, on both sides of the slide, which grip into the cantilever component's elongated slots.

The stops for fixing the upper position of the cantilever are very simply formed, if they are each made up of a projection, which is provided below the swivelling axis journal at the rear area of the slide's lateral surface facing the swivelling axis journal. In such a construction, it is inevitable that locking occurs because the cantilever, in its upper position, slips unavoidably so far downwards with its elongated slots over the swivelling axis journal, owing to its weight, that it grips behind the projections.

The stop for the standard side component's horizontal position may, in a simple way, be made up of a projection provided on the front of the slide, below the swivelling axis journal.

The invention permits numerous embodiments. To clarify further the basic principle of the invention, a schematic drawing of the latter is represented and subsequently described.

DESCRIPTION OF THE PREFERRED EMBODIMENTS

Figure 1:
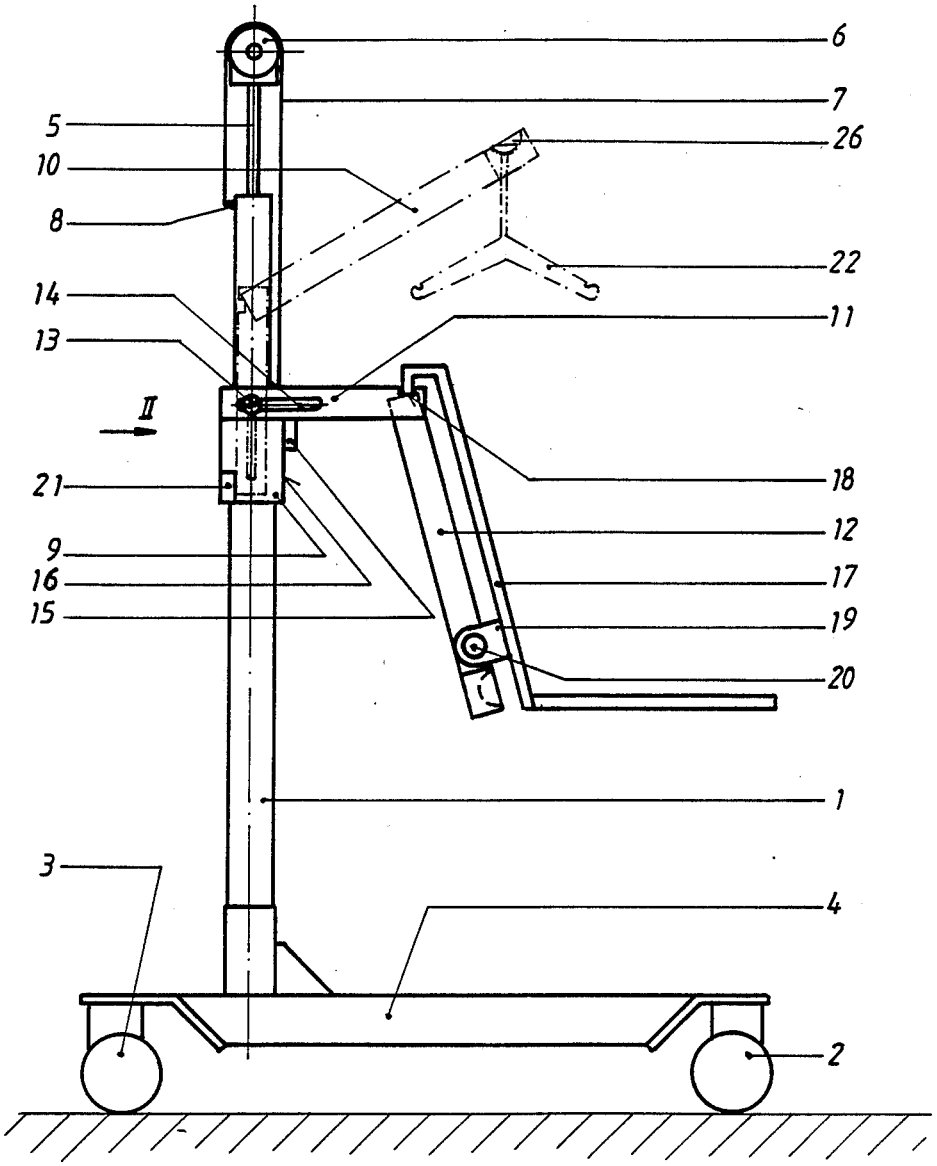
FIG. 1 shows a side view of the invalid lifting and carrying apparatus according to the invention.

FIG. 1 shows a standard 1, which stands in vertical alignment on wheels 2, 3 of a base frame 4. A piston rod 5, which at its upper end bears a turning point 6 in the form of a wheel, may be moved out of the standard 1 by a movement towards the top. A cable 7 is fastened, by one end, at a fixing point 8 at the top of the standard 1 and runs upwards to the turning point 6 and then back down again, on the other side of the piston rod 5, to a slide 9, fastened on the outer side of the standard 1. The other end of the cable 7 is fastened to the slide 9 so that the slide 9 is able to move along the standard 1. If the piston rod 5 moves upwards, using the turning point 6, the slide 9 is pulled twice as far upwards on the standard 1.

Of great importance to the invention is a cantilever 10, consisting of two cantilever components 11, 12, which meet at an obtuse angle. The cantilever is maintained able to swivel at the slide 9 around a swivelling axis journal 13. This swivelling axis journal 13 grips into an elongated slot 14 in the cantilever component 11. In the position represented, the cantilever component 11 rests on a stop 15 in the form of gib, fastened to the front 16 of the slide 9.

If the cantilever component 11 is in horizontal alignment a seat 17 may be inserted into the cantilever 10 which grips down into a recess 18 in the cantilever component 11 and close to the lower end is led through the cantilever component 12 with a retention link 19 and by means of a catch 20 secured there.

If the seat 17 is removed, the cantilever 10 may be tilted by 90 degrees counter-clockwise around the swivelling axis 13 according to the length of the elongated slot 14, may then be left extending downwards. The cantilever component 11 then grips behind a stop 21, which is represented in FIG. 1 by dashes and dots. If the cantilever 10 is to be moved out of the position represented by dashes and dots back into the position for holding the seat 17, the cantilever 10 must firstly be lifted a little, so that the cantilever component 11 is released from the stop 21. The position of the cantilever 10, shown in dashes and dots, serves for fastening a hanger 22 of a belt device (not shown) into a lug 26 at the front end of the cantilever 10. This lug 26 may also be provided on a member telescopically removable from the cantilever component 12 of the cantilever 10, in order to attain greater projection.

Figure 2:
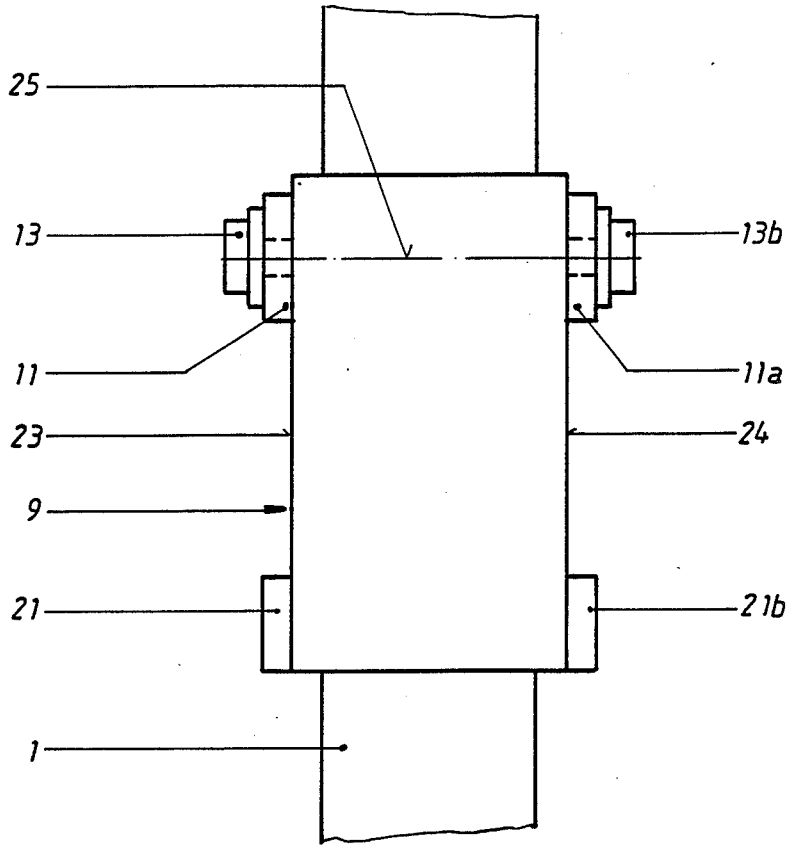
FIG. 2 shows an enlarged representation of FIG. 1 from the rear, focusing on an area of the apparatus, according to FIG. 1, which is essential to the invention.

FIG. 2 clarifies that the cantilever 10 is fork-shaped and that the cantilever component 11, 11*a* grips on both sides over a lateral surface 23, 24 of ther slide 9. On each lateral surface a swivelling axis journal 13, 13*b* is accordingly provided. The swivelling axis formed by the latter is positioned in FIG. 2 with 25. Furthermore, FIG. 2 shows that on each lateral surface 23, 24 of the slide 9 a stop 21, 21*b* is provided at the lower area.

What is claimed is:

1. Invalid lifting and carrying apparatus comprising:
   a frame;
   a vertical standard supported by said frame;
   slide means movably mounted to said standard and vertically movable thereon; and
   cantilever means comprising a first cantilever component and a second cantilever component joined unadjustably at an obtuse angle;
   wherein said first cantilever component is pivotally mounted to said slide means at a swiveling axis; and
   wherein said cantilever means is pivotally movable between a first position for holding a seat and a second position for carrying a belt device.

2. Invalid lifting and carrying apparatus according to claim 1, wherein said slide means comprises at least one first stop and at least one second stop, wherein said first cantilever component has at least one elongate slot which cooperates with said swiveling axis, and wherein when said cantilever means is in said first position said first cantilever component communicates with said first stop and when said cantilever means is in said second position said first cantilever component communicates with said second stop.

3. Invalid lifting and carrying apparatus according to claim 2, wherein said first cantilever component is fork-shaped, wherrein said first cantilever component has two elongate slots, and wherein said slide means comprises two first stops and two second stops.

4. Invalid lifting and carrying apparatus according to claim 2, wherein said at least one first stop comprises a projection, and wherein said at least one first stop is disposed below said swiveling aixs on a side of said slide means opposite said second cantilever component.

5. Invalid lifting and carrying apparatus according to claim 2, wherein said at least one second stop comprises a projection, and wherein said at least one first stop is disposed below said swiveling axis on a side of said slide means facing said second cantilever component.

* * * * *